United States Patent [19]

Glaeser

[11] Patent Number: 4,680,813

[45] Date of Patent: Jul. 21, 1987

[54] BODY PROTECTIVE GARMENT

[76] Inventor: Robert B. Glaeser, 108 "C" St., Martinez, Calif. 94553

[21] Appl. No.: 711,039

[22] Filed: Mar. 12, 1985

[51] Int. Cl.[4] ..... A41D 13/00

[52] U.S. Cl. ..... 2/2; 2/DIG. 1

[58] Field of Search ..... 2/2, DIG. 1

[56] References Cited

U.S. PATENT DOCUMENTS

| | | | |
|---|---|---|---|
| 1,241,025 | 9/1917 | Sagerstrom | 2/2 |
| 1,837,499 | 12/1931 | Sparhawk | 2/2 |
| 2,079,980 | 5/1937 | Anders | 2/DIG. 1 |
| 2,990,549 | 7/1961 | Doughty | 2/2 |
| 3,257,666 | 6/1966 | Hoffman | 2/2 |
| 4,422,183 | 12/1983 | Landi et al. | 2/2 |
| 4,441,211 | 4/1984 | Donzis | 2/2 |
| 4,497,069 | 2/1985 | Braunhut | 2/2.5 |

*Primary Examiner*—Louis K. Rimrodt

*Attorney, Agent, or Firm*—Schapp and Hatch

[57] ABSTRACT

A body protective garment including a fabric shell and woven fasteners for fastening body protective pads to its inner surface.

3 Claims, 4 Drawing Figures

BODY PROTECTIVE GARMENT

BACKGROUND OF THE INVENTION

1. Field of the Invention

My invention relates to body protective garments, and more particularly to body protective garments for use by refuse packers, warehousemen, stevedores, and other workers who are engaged in occupations in which heavy loads are borne by those workers in contact with their bodies, and such heavy loads are rigid, contained in rigid receptacles, and/or provided with rigid projections, such as shoulder hooks, handles, and the like.

2. Description of the Prior Art

Body protective garments have long been known in the prior art. For example, body protective garments are shown and described in the following United States patents.

U.S. Pat. No. 308,244
U.S. Pat. No. 1,088,891
U.S. Pat. No. 1,657,866
U.S. Pat. No. 2,063,469
U.S. Pat. No. 3,135,961
U.S. Pat. No. 4,302,847

The term "prior art" as used herein or in any statement made by or on behalf of applicant means *only* that any document or thing referred to as prior art bears, directly or inferentially, a date which is earlier than the effective filing date hereof.

It is to be noted that a substantial percentage of these prior art body protective garments are not designed for or related to the problems encountered by workers engaged in the occupations referred to above, but rather are designed for or related to the problems encountered by athletes, sportsmen, and the like.

Further, it is to be noted that other ones of these prior art body protective devices, while they are related to occupations of the type discussed above under Field of the Invention, are related to the problems encountered by workers in an earlier day when the pace of the work was slower as contrasted with the pace of such work today, which is largely determined by the capabilities of auxiliary mechanical apparatus such as motor trucks, automatic loading equipment, and the like.

It is believed that the documents listed immediately below contain information which might be contended by someone to be material to the examination of this patent application.

U.S. Pat. No. 1,414,136
U.S. Pat. No. 1,695,709
U.S. Pat. No. 1,802,290
U.S. Pat. No. 2,385,315
U.S. Pat. No. 2,986,783

No representation or admission is made that any of the immediately above-listed documents is part of the prior art, or that a search has been made, or that no more pertinent information exists.

SUMMARY OF THE INVENTION

Accordingly, it is an object of my invention to provide body protective garments adapted to protect the bodies of workers engaged in occupations in which heavy loads carried by the workers contact their bodies, and such heavy loads are rigid, contained in rigid receptacles, and/or provided with rigid projections, such as shoulder hooks, handles, and the like; which occupations will be called "rigid load contact occupations" herein.

Another object of my invention is to provide body protective garments for protecting refuse packers from the bruising and other body damage produced by the packing barrels which they employ in carrying refuse from temporary storage locations to collection trucks, and produced by the shoulder hooks with which such packing barrels are equipped and by rigid and sharp refuse being transported by means of those packing barrels.

Yet another object of my invention is to provide body protective garments of the kind described above which interfere minimally with the strenuous lifting and stretching motions which such refuse packers regularly perform in carrying out their duties.

A further object of my invention is to provide body protective garments of the kind described above which embrace a large part of the worker's body, and thus maintain the necessary body part protective pads in their optimally protective locations.

An additional object of my invention is to provide body protective garments of the kind described above which are so constructed and arranged that the principal part of the garment can readily be cleaned without harming the body protective pads incorporated into the garment.

Yet another object of my invention is to provide body protective garments of the kind described above which can be worn without undue buildup of body heat, even when the user is engaged in strenuous activity as part of his work.

It is a yet further object of my invention to provide body protective garments which have a broad range of uses, i.e., in portaging canoes, erecting tying steel for poured and preformed concrete buildings, backpacking, general construction work, and furniture moving.

Other objects of my invention will in part be obvious and will in part appear hereinafter.

My invention, accordingly, comprises the garments embodying features of construction, combinations of elements, and arrangements of parts all of which are exemplified in the following disclosure, and the scope of my invention will be indicated in the appended claims.

In accordance with a principal feature of my invention, a body protective garment is provided which comprises a vest-like shell of heavy-duty fabric similar to waterproof nylon backpack cloth to which shell are removably affixed a plurality of fastener means, e.g., woven fastener means of the type made and sold under the trademark Velcro, by means of which a plurality of fabric-encased body protective pads of high-density foam material can be removably affixed to said shell at predetermined locations The term "woven fastener" as used herein denotes any fastener of the kind generally known by the trademark Velcro, and includes those fasteners shown and described in U.S. Pat. Nos. 2,717,437; 3,279,008; and 3,461,511, and the like.

In accordance with another principal feature of my invention said body protective pads are contained in tight-fitting fabric envelopes formed from a fabric similar to that of said shell, to which envelopes woven fasteners corresponding to woven fasteners in the shell are secured, whereby said shell can be frequently washed without adversely effecting said pads.

In accordance with yet another principal feature of my invention, said shell is provided with a plurality of ventilator panels of heavy-duty nylon netting or the like, whereby to prevent the accumulation of excess body heat within the shell when the wearer is engaged in strenuous activity.

In accordance with an additional principal feature of my invention, said pads are located not only where the wearer's body would otherwise be contacted by a shoulder hook or other load container projection but also in other places where the rigid load or load container would otherwise contact the wearer's body. In a garment of my invention designed to protect refuse packers from the packing barrels which they use in carrying loads of refuse, for example, the pads are located (inside the shell) not only in the shoulder area, which is normally contacted by the shoulder hook of the packing barrel, but also in the spinal and pelvic areas For a fuller understanding of the nature and objects of my invention reference should be had to the following detailed description, taken in connection with the accompanying drawings.

DESCRIPTION OF THE PREFERRED EMBODIMENTS

Figure 1:
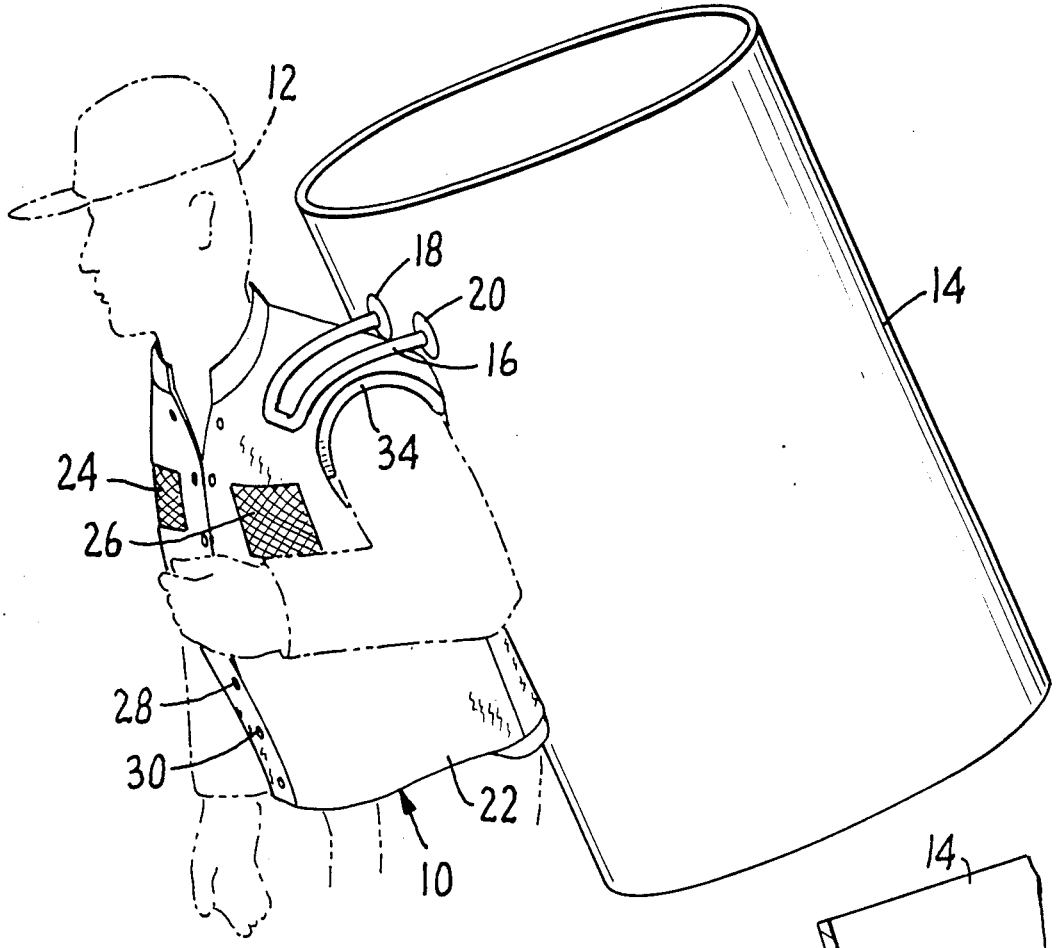
FIG. 1 is a perspective view of a refuse packer wearing a body protective garment of my invention while carrying a conventional packing barrel by means of a conventional packing barrel shoulder hook.

Referring now to FIG. 1, there is shown a protective garment 10 constructed in accordance with the first preferred embodiment of my invention, worn by a refuse packer 12 who is carrying a packing barrel 14 of well known type. In the well known manner, packing barrel 14 is provided with a shoulder hook 16 which is rigidly affixed to packing barrel 14 by well known securing means 18, 20, whereby it remains in the orientation with respect to packing barrel 14 which is indicated in FIG. 1.

In accordance with the now well known practice of domestic and commercial refuse collection, the refuse to be collected is transported from its temporary residential or commercial storage location, e.g., a small plurality of barrels, by a refuse packer 12, who first discharges the contents of a plurality of these temporary storage barrels into a larger packing barrel 14 and then carries the packing barrel from the temporary storage location to the collection truck by engaging shoulder hook 16 with his shoulder in the manner indicated in FIG. 1.

I have found, however, that without protection the body of the packer is subject to continual bruising and abuse, which is sometimes not merely superficial, but involves deep damage to the musculature of the shoulder.

I have further found that such packers also sustain bruising and other body damage in other body areas than the shoulder, e.g., the vertebral and pelvic regions of the body.

Some if not all refuse packers are or become concerned with this constant bruising and deeper tissue damage, because of the possible long-range effects thereof, not to say the constant discomfort or outright pain occasioned by some if not all of these insults to the body.

Therefore, the protective garment 10 of my invention is so constructed and arranged as to securely locate protective padding over these imperiled areas of the body, and to maintain the same against slippage whereby to permit maximum work efficiency and comfort to the packer.

At the same time, protective garment 10 is provided with ventilating means whereby to prevent undue accumulation of body heat within the vest-like shell 22 thereof.

Two of these ventilating means 24, 26 are shown in FIG. 1, and are described in more detail hereinafter.

As further seen in FIG. 1, shell 22 generally resembles an ordinary vest in that it is a sleeveless, body-embracing garment the front panels of which can be joined by means of heavy-duty industrial snap fasteners 28, 30, etc. Shell 22 is preferably formed from a heavy-duty, wear-resistant fabric, such as waterproof nylon backpack cloth.

The several ventilators, including ventilators 24 and 26 shown in FIG. 1, are preferably fabricated from heavy-duty nylon netting, similar to that used for heavy-duty industrial lawnmower grass collector bags.

Figure 3:
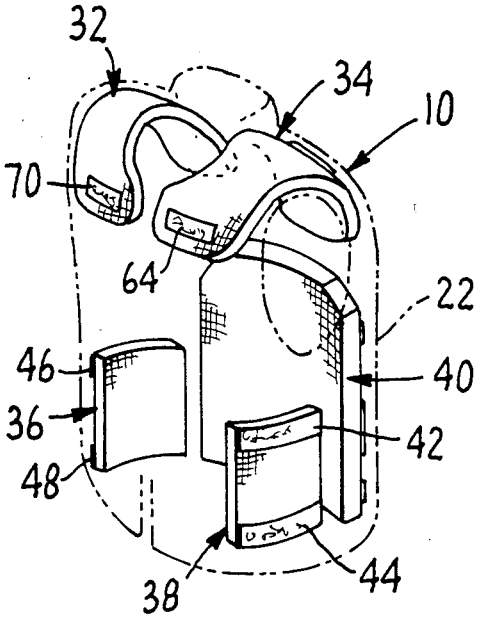
FIG. 3 is a perspective view, partly in phantom, of the protective garment of my invention shown in FIGS. 1 and 2.

Referring now to FIG. 3, it will be seen that shell 22 is shown in phantom, so that the shape and location of the protective pads of body protective garment 10 can best be understood.

As seen in FIG. 3, body protective garment 10 is provided with five body protective pads 32, 34, 36, 38, 40.

Each of these pads is fabricated from high-density foam and then sewn into an envelope of waterproof cloth, which envelope is itself provided with a plurality of woven fasteners adapted to cooperate with similar woven fasteners affixed to the internal face of shell 22 for the purpose of positioning these pads on the inside of shell 22 in the manner illustrated in FIG. 3.

Thus, it is to be understood that, e.g., pad 38 shown in FIG. 3 is a generally rectangular billet of high-density foam which is permanently sewn within an envelope of waterproof cloth.

As further seen in FIG. 1, the face of pad 38 which is to be juxtaposed to the inner face of shell 22 is provided with two woven fasteners 42, 44. Fasteners 42, 44 may be affixed to the waterproof fabric envelope of pad 38 by sewing or cementing, all in the well known manner.

As further seen in FIG. 3, pad 36 is also a high-density foam pad encased in a fabric envelope, which fabric envelope is provided with two woven fasteners 46, 48 similar to fasteners 42, 44.

The construction of body protective garment 10 is described in greater detail hereinafter in connection with FIG. 4.

Figure 2:
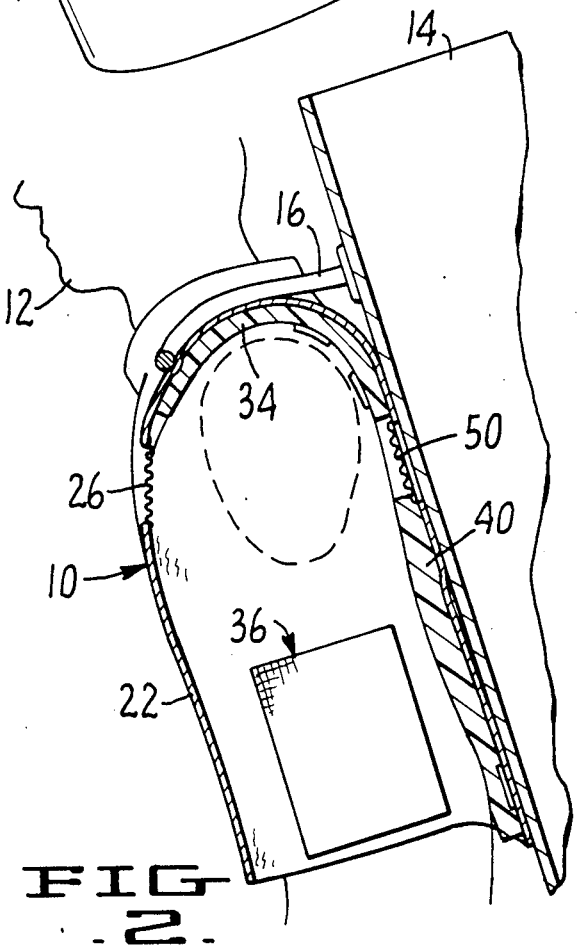
FIG. 2 is a side view, partly in section and partly in phantom, of the refuse packer and packing barrel shown in FIG. 1.

Referring now to FIG. 2, it will be understood by those having ordinary skill in the art, informed by the present disclosure, that shell 22 of protective garment 10 serves to maintain pad 34 properly positioned over the left shoulder of packer 12 so that it is interposed between the shoulder hook 16 of packing barrel 14 and the packer's shoulder.

As further seen in FIG. 2, shell 22 of protective garment 10 further serves to maintain protective pad 40 in such a position on the body of packer 12 that it protects packer 12 from direct body contact with the rigid wall of packing barrel 14.

Figure 4:
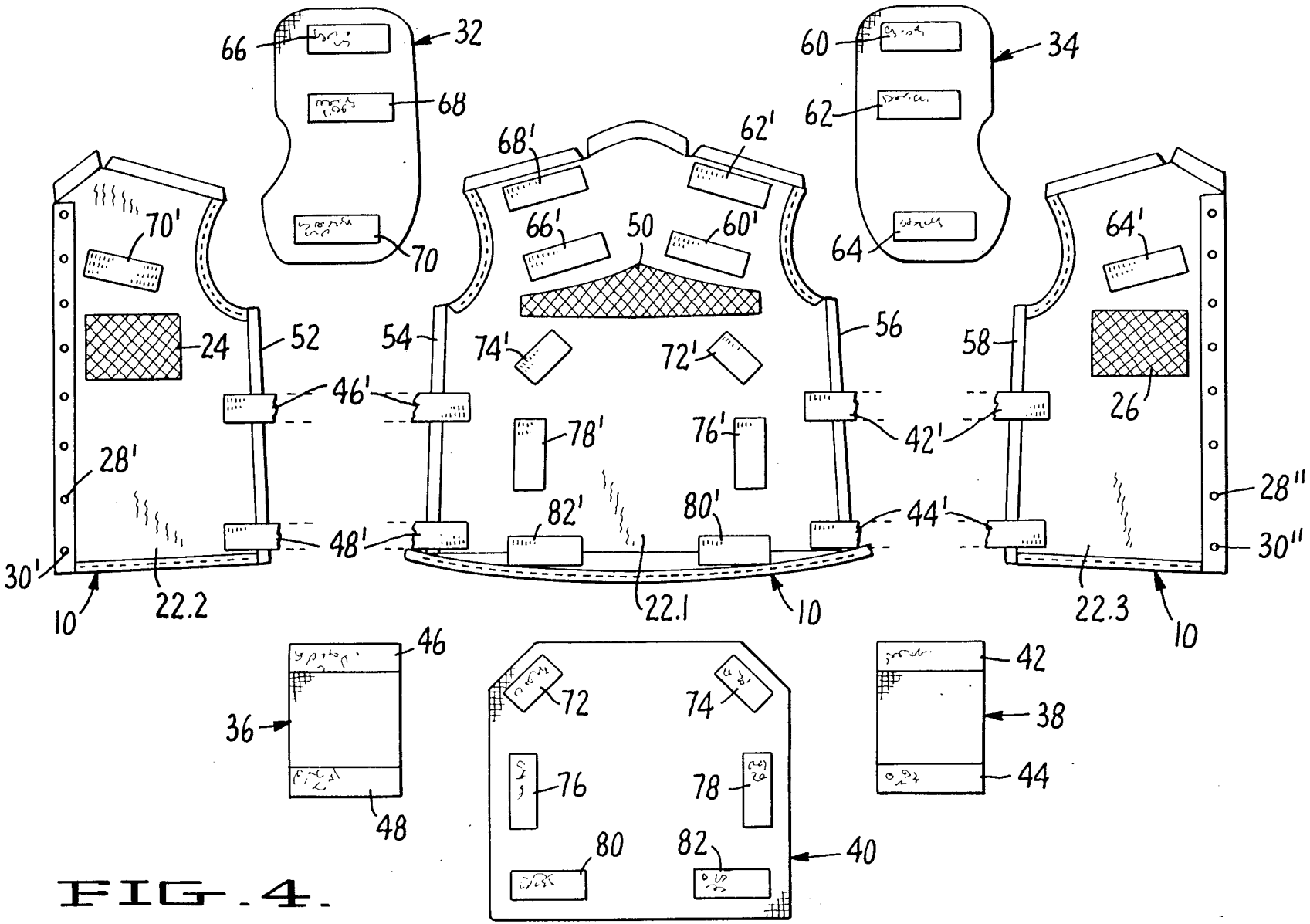
FIG. 4 is an exploded view of the body protective garment shown in FIGS. 1 through 3.

Referring now to FIG. 4, it will be seen that shell 22 is comprised of three panels, viz., a back panel 22.1, a right-front panel 22.2, and a left-front panel 22.3.

Shell 22 is in general fabricated by sewing in the well known manner, and the exposed edges of each panel hemmed in the well known manner to prevent fraying, etc.

As also seen in FIG. 4, protective garment 10 is also provided with three ventilator panels 24, 26, 50, each of which is sewn across a corresponding opening in one of the panels of shell 22.

The panels 22.2 and 22.3 are provided, alternately, with the mating halves 28' and 28" of snap fastener 28, etc.

The edges 52 and 54 of panels 22.2 and 22.1 are seamed together by sewing in the well known manner, and the edges 56 and 58 of panels 22.3 and 22.1 are seamed together in the same manner.

A pair of woven fastener strips 46' and 48' are affixed to the inner surface of panels 22.2 and 22.1, passing over the seam 52, 54, and thus are able to cooperate with woven fastener strips 46, 48 in maintaining fabric-encased protective pad 36 in the position within shell 22 which is indicated in FIG. 3.

Similarly, a pair of woven fasteners 42', 44' overlying seam 56, 58 served to cooperate with woven fasteners 42, 44, respectively, in maintaining fabric-covered protective pad 38 in its predetermined position on the inner surface of shell 22 indicated in FIG. 3.

As seen from these examples, the convention is adopted herein of designating each pair of cooperating woven fasteners, one by a particular reference numeral and the other by the same reference numeral primed.

Thus, the three woven fasteners 60, 62, 64 which are adherred to fabric-covered protective pad 34 (FIG. 4) cooperate, respectively, with woven fastener 60', 62', 64' in maintaining pad 34 in its operative position in the shoulder of protective garment 10.

Similarly, woven fasteners 66, 68, 70, all of which are adherred to fabric-covered pad 32, cooperate, respectively, with woven fasteners 66', 68', 70', all of which are adherred to the inside of shell 22, to maintain pad 32 in its desired shoulder-protecting position within shell 22.

In the same manner, woven fasteners 72, 74, 76, 78, 80, 82, all of which are adherred to fabric-covered pad 40 cooperate with woven fasteners 72', 74', 76', 78', 80', 82', all of which are affixed to the inner surface of shell 22, to maintain pad 40 in its desired protective position within shell 22.

It will thus be seen that the objects set forth above, among those made apparent from the preceding description, are efficiently attained, and since certain changes may be made in the above constructions without departing from the scope of my invention, it is intended that all matter contained in the above description or shown in the accompanying drawings shall be interpreted as illustrative only, and not in a limiting sense.

In certain embodiments of my invention particular ones of said pads, e.g., pads 32 and 34 may be made in whole or in part from unfoamed, or in some cases high density, rubber or other elastomer. In certain embodiments of my invention a larger part or all of shell 22 may be made from foraminous material such as the heavy-duty nylon netting used in ventilators 26 and 27.

It is also to be understood that the following claims are intended to cover all of the generic and specific features of my invention hereindescribed, and all statements of the scope of the invention which, as a matter of language, might be set to fall therebetween.

What is claimed is:

1. A protective garment for workers in the rigid load contact occupations, comprising:

a garment adapted to embrace the torso of such a worker when worn by that worker;

protective pad means adapted to confront the upper and rear surfaces of at least one shoulder of said worker and a substantial part of the rear surface of said worker's torso; and woven fastener means for removably fastening said protective pad means to the parts of said garment which confront said surfaces when said garment is worn by said worker.

2. A protective garment as claimed in claim 1, further comprising additional protective pad means for protecting at least one of the hip areas of said worker and woven fastener means for removably fastening said additional body protective pad means to the part of said garment which confronts said at least one hip areas when said garment is worn by said worker.

3. A protective garment as claimed in claim 1 in which said garment is provided with at least one ventilator.

* * * * *